US011661297B2

(12) United States Patent
Dominak et al.

(10) Patent No.: US 11,661,297 B2
(45) Date of Patent: May 30, 2023

(54) METHOD OF LOADING A DUNNAGE CONVERSION MACHINE AND SHEET STOCK MATERIAL USEFUL THEREIN

(71) Applicant: Ranpak Corp., Concord Township, OH (US)

(72) Inventors: Stephen Louis Dominak, Brecksville, OH (US); Alexandra Snijders, Kerkrade (NL)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 17/104,141

(22) Filed: Nov. 25, 2020

(65) Prior Publication Data

US 2021/0078817 A1 Mar. 18, 2021

Related U.S. Application Data

(62) Division of application No. 15/574,023, filed as application No. PCT/US2016/032649 on May 16, 2016, now Pat. No. 10,875,733.

(Continued)

(51) Int. Cl.
*B65H 19/18* (2006.01)
*B31D 5/00* (2017.01)

(52) U.S. Cl.
CPC ..... *B65H 19/1852* (2013.01); *B31D 5/0043* (2013.01); *B65H 2301/46017* (2013.01); *B65H 2801/63* (2013.01)

(58) Field of Classification Search
CPC .... B31D 2205/0035; B31D 2205/0023; B31D 2205/0017; B31D 2205/0011;

(Continued)

(56) References Cited

U.S. PATENT DOCUMENTS 5,749,824 A * 5/1998 Guth ..... B31D 5/0047 493/464
6,756,096 B2 * 6/2004 Harding ..... B31D 5/0047 428/40.1

(Continued)

FOREIGN PATENT DOCUMENTS

DE 2714854 A1 10/1978
DE 202014009847 U1 1/2015

(Continued)

OTHER PUBLICATIONS

International Search Report and Written Opinion dated Oct. 11, 2016, for International Patent Application No. PCT/US2016/032649.

*Primary Examiner* — Thomas M Wittenschlaeger
(74) *Attorney, Agent, or Firm* — Renner, Otto, Boisselle & Sklar, LLP

(57) ABSTRACT

A supply of stock material for a dunnage conversion machine includes two plies of sheet stock material wound into a roll or fan-folded into a stack. Each ply has disposed on a corresponding leading or trailing end thereof an adhesive layer and a removable release liner covering the adhesive layer. When applied to a leading end of the supply, the adhesive layer is applied to opposing, outwardly-facing surfaces of the respective plies. When a supply of stock material is almost spent, the operator removes the release liners from both plies to expose respective adhesive layers, and then interposes the leading end of a new supply between the plies of the trailing end of the almost-spent supply and presses the layers together to attach the plies of the new supply to respective plies of the almost-spent supply, for conversion into dunnage.

14 Claims, 7 Drawing Sheets

Related U.S. Application Data

(60) Provisional application No. 62/161,563, filed on May 14, 2015.

(58) Field of Classification Search
CPC ..... B31D 2205/0005; B31D 5/006; B31D 5/0052; B31D 5/0047; B31D 5/0043
See application file for complete search history.

(56) References Cited

U.S. PATENT DOCUMENTS

| | | | | |
|---|---|---|---|---|
| 7,803,242 | B2 * | 9/2010 | Hagman | B65H 39/16 156/159 |
| 9,505,197 | B2 | 11/2016 | Umemoto | |
| 9,808,131 | B2 * | 11/2017 | Larsson | B65D 85/62 |
| 10,875,733 | B2 * | 12/2020 | Dominak | B31D 5/0043 |
| 2002/0100539 | A1 * | 8/2002 | Harding | B65H 19/1852 156/157 |
| 2003/0089760 | A1 * | 5/2003 | Nobbe | B29C 65/02 228/171 |
| 2003/0216236 | A1 * | 11/2003 | Harding | B65D 75/56 493/350 |
| 2007/0029037 | A1 * | 2/2007 | Deininger | B65B 41/12 156/293 |
| 2008/0308213 | A1 * | 12/2008 | Hagman | B65H 19/1852 83/109 |
| 2009/0082187 | A1 * | 3/2009 | Cheich | B31D 5/0047 53/472 |
| 2011/0111940 | A1 * | 5/2011 | Carlson | B31D 5/0047 493/405 |
| 2012/0035038 | A1 * | 2/2012 | Lembach | B65H 21/00 493/381 |
| 2015/0119224 | A1 * | 4/2015 | Orsini | B31D 5/0043 493/464 |
| 2016/0120377 | A1 * | 5/2016 | Larsson | A47K 10/42 29/428 |

FOREIGN PATENT DOCUMENTS

| | | | |
|---|---|---|---|
| JP | 2004513806 | A | 5/2004 |
| JP | 200423677 | A | 1/2009 |
| JP | 2015101486 | A | 6/2015 |
| KR | 101037228 | B1 | 5/2011 |
| WO | 2009148910 | A2 | 12/2009 |

* cited by examiner

METHOD OF LOADING A DUNNAGE CONVERSION MACHINE AND SHEET STOCK MATERIAL USEFUL THEREIN

This application claims priority of U.S. patent application Ser. No. 15/574,023, filed Nov. 14, 2017, which claims priority of International Patent Application No. PCT/US2016/032649, filed May 16, 2016, which claims priority of U.S. Provisional Application No. 62/161,563, filed May 14, 2015, which are hereby incorporated herein by reference.

FIELD OF THE INVENTION

The present invention relates to machines for converting sheet stock material into a dunnage packaging product and, more particularly, to a method and supply of two-ply stock material supply that facilitates splicing a new or succeeding supply of stock material to an almost-spent supply of stock material.

BACKGROUND

Dunnage conversion machines convert sheet stock material from a supply thereof into a relatively less dense dunnage product useful in packaging to protect articles during shipment. The sheet stock material usually is supplied in the form of a roll or a fan-folded stack, from which the sheet stock material is payed off for conversion by the machine into the dunnage product.

When the supply is spent, a new supply is loaded in place of the spent supply and the leading end of the new supply is inserted into the machine. Because it can be difficult to get the new supply to feed properly, operators have learned to stop the machine before the trailing end of the sheet material enters the machine, and to splice the leading end of the new supply to the trailing end of the almost-spent supply. When the machine is operated once again, the trailing end of the almost spent supply will pull the leading end of the new supply into and through the machine.

Common splicing techniques include using one or more strips of tape to attach a leading end of the succeeding supply of stock material to a trailing end of the almost-spent supply of stock material, and spraying a liquid adhesive on the trailing end of the almost spent supply and then pressing the leading end of the succeeding supply to the adhesive-covered trailing end.

Another technique is to pre-apply a double-sided adhesive to the leading or trailing ends of the supply, with a removable covering that the operator can remove before splicing the leading end of the succeeding supply of stock material to the trailing end of the almost spent supply of stock material. This latter technique is described in commonly-owned U.S. Pat. No. 6,756,096, which is hereby incorporated herein by reference. When this technique is used with a multi-ply sheet stock material, an adhesive strip must be applied to each ply, and each ply must be attached to a corresponding ply in a particular sequence. For example, the removable covering is removed from the adhesive on a first ply, and the leading ends and trailing ends of the corresponding plies furtherest from the operator are attached together. Then the removable covering is removed from the adhesive on a second ply, and the next-nearest (relative to the operator) corresponding plies are attached together. This process is repeated until all of the plies are spliced.

SUMMARY

The present invention provides an improved splicing method, particularly for two-ply sheet stock material, and an improved supply of two-ply sheet stock material, both of which simplify the process of splicing a succeeding or new supply of two-ply stock material to an almost-spent supply of two-ply stock material.

According to the present invention, a supply of sheet stock material includes two plies of sheet stock material rolled or folded into a compact configuration, such as a roll of wound material or a stack of fan-folded material. The leading ends of the plies of the new supply are temporarily secured together, and an adhesive is pre-applied to each of the outwardly-facing opposing surfaces of respective plies if on the leading end of the new supply, or to each of the inwardly-facing opposing surfaces of respective plies if on the trailing end. A removable covering or release liner typically covers the adhesive until ready for splicing. In use, the release liner is removed and the leading ends of the plies of the new supply, which are temporarily attached to one another, are placed between the trailing ends of the respective plies of the almost-spent supply, and the plies are readily secured by pressing the overlapping plies together, without any sequencing limitation. In other words, no extra care is required to ensure that the correct plies of the respective supplies are being attached together in the correct sequence, as was required in prior methods and supplies of sheet stock material. The leading ends of the plies of the new supply may remain connected together until drawn through the conversion machine, which may separate the plies or allow the plies to remain connected.

More particularly, and generally paraphrasing the original claims, the present invention provides a supply of sheet stock material suitable for use in a dunnage conversion machine that includes a first ply of sheet stock material and a second ply of sheet stock material that overlaps the first ply. The first ply and the second ply both have an adhesive layer adjacent one of a leading end or a trailing end of each ply. The adhesive layer is applied to opposing outwardly-facing surfaces of the respective plies if adjacent the leading ends and the adhesive layer is applied to respective inwardly-facing surfaces of the respective plies if adjacent the trailing ends.

The first ply and the second ply may be attached to one another adjacent their respective leading ends. For example, the first ply and the second ply may be secured together with an adhesive between inwardly-facing surfaces of the plies.

The first and second plies may be rolled or folded into a compact configuration. For example, the first and second plies may be rolled around a common core to form a roll of two-ply sheet stock material. Alternatively, the first and second plies may be fan-folded to form a stack of two-ply sheet stock material.

The first ply and the second ply may include paper. The first and second plies may have substantially the same width dimension. The leading end of the first ply may be aligned with the leading end of the second ply.

The adhesive layer may be disposed on a carrier and may be covered by a removable release liner. The adhesive layer may be adjacent a leading end of each ply. The adhesive layer may include a pressure sensitive adhesive and a removable release liner covering the pressure sensitive adhesive.

The adhesive layer may be applied across substantially the full width of at least one ply. The adhesive layer may have a substantially continuous length. The adhesive layer may have a major dimension that extends parallel to a width dimension of the overlapping plies. The adhesive layer on the first ply may be aligned with the adhesive layer on the second ply.

The present invention also provides a method of converting a two-ply sheet stock material into a relatively lower density dunnage product. The method includes the following steps: (a) operating a dunnage conversion machine to produce one or more dunnage products from a supply of sheet stock material having a first ply and a second ply until the supply of sheet stock material is almost spent, the supply being a preceding supply, (b) displacing a trailing end of the second ply of the preceding supply of sheet stock material to expose a trailing end of the first ply of the preceding supply of sheet stock material, (c) providing a succeeding supply of two-ply sheet stock material having a first ply and a second ply that overlaps the first ply, (d) attaching a leading end of the first ply of the succeeding supply of sheet stock material to the first ply of the preceding supply of sheet stock material, (e) replacing the trailing end of the second ply of the preceding supply of sheet stock material over the leading end of the second ply of the succeeding supply of sheet stock material to secure the second ply of the succeeding supply of sheet stock material to the second ply of the preceding supply of sheet stock material, and (f) operating the dunnage conversion machine once again to produce one or more dunnage products from the succeeding supply of sheet stock material.

The attaching step may include removing a release liner covering a pressure sensitive adhesive layer and applying pressure to the sheet stock material adjacent the adhesive layer.

The method may further include the step of connecting the leading ends of the first ply and the second ply of the succeeding supply of sheet stock material before the attaching step.

The foregoing and other features of the invention are hereinafter fully described and particularly pointed out in the claims, the following description and the annexed drawings setting forth in detail plural illustrative embodiments of the invention, such being indicative, however, of but a few of the various ways in which the principles of the invention may be employed.

DETAILED DESCRIPTION

Figure 1:
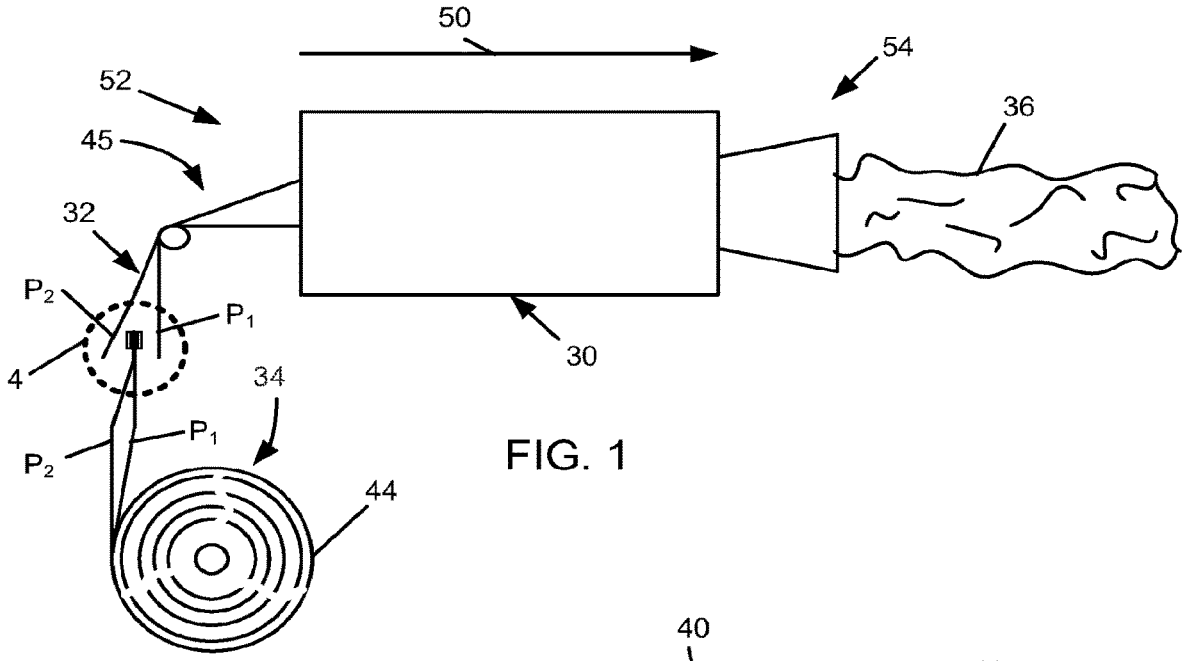
FIG. 1 is a schematic illustration of a supply of sheet stock material in roll form and a dunnage conversion machine in accordance with the present invention.
Figure 2:
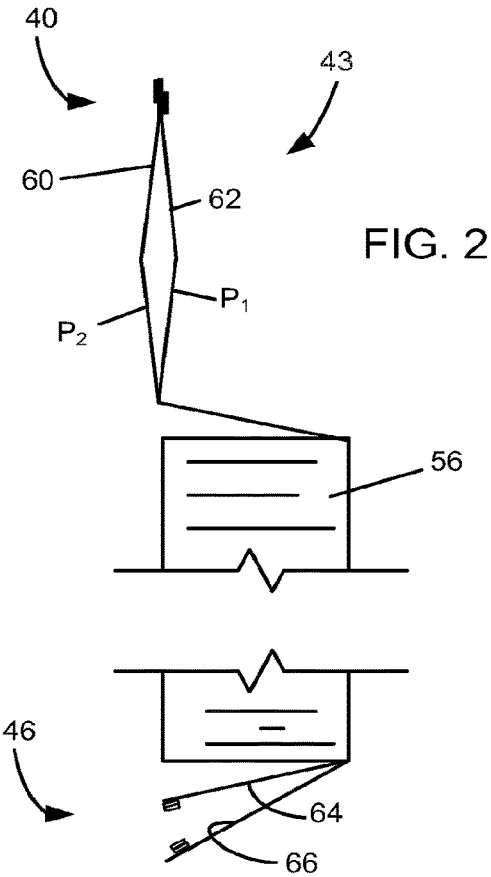
FIG. 2 is a schematic illustration of an alternative supply of sheet stock material in the form of a fan-folded stack.
Figure 3:
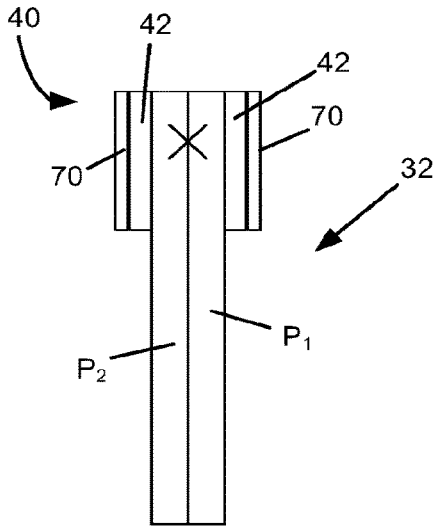
FIG. 3 is a schematic enlarged view of a leading end of a sheet stock material provided by the invention.

Referring now to the drawings in detail and initially to FIGS. 1 through 3, a schematic dunnage conversion machine is designated generally by reference number 30. As is further described below, the conversion machine 30 converts a sheet stock material 32 from a supply 34 or 43 thereof into a relatively lower density dunnage product 36, such as a randomly crumpled paper dunnage product. The supply 34 and 43 of sheet stock material includes two overlapping plies $P_1$ and $P_2$, typically connected together at a leading end 40, and includes an adhesive layer 42 that enables splicing a new or succeeding supply 34 or 43 of sheet stock material (roll 44 in FIG. 1) to an almost-spent supply 45 of sheet stock material in a relatively simple and quick manner. Trailing ends 46 of the almost-spent stock supply 45 extend from the machine 30, the trailing end 46 being longitudinally opposite the leading end 40.

In FIG. 1, the dunnage conversion machine 30 pulls the sheet stock material 32 from the supply 34 in a downstream direction 50 from an upstream end 52 of and through the conversion machine 30. The conversion machine 30 converts the stock material 32 into a relatively less dense dunnage product 36, such as by shaping and randomly crumpling the sheet material, typically that the conversion machine 30 dispenses from a downstream end 54, opposite the upstream end 52.

The supply of stock material 34 generally is provided in a compact configuration, such as a roll of stock material 44 (FIG. 1) or a generally rectangular stack of fan-folded stock material 56 (FIG. 2). The stock material 32 includes two plies $P_1$ and $P_2$ of sheet material, or multiples thereof, where each ply generally includes paper, for example, such as thirty-pound basis weight kraft paper. Also, one or more of the plies may be made of another type of sheet material, such as a plastic, or different types of paper, such as printed paper, bleached paper, fifty-pound kraft paper, or combinations thereof. The plies $P_1$ and $P_2$ generally are coextensive, overlay each other, and have the same width and length. One ply may be narrower than the other, however.

The supplies 34 and 43 of sheet stock material 32 shown in FIGS. 1 and 2 have a gap between the overlapping plies $P_1$ and $P_2$ near the leading ends 40 to demonstrate the presence of two plies, but when a leading end 40 of the sheet stock material 32 is pulled from the supply 34 or 43, the plies $P_1$ and $P_2$ generally will be parallel to one another. As described above, the two plies $P_1$ and $P_2$ of the sheet stock material 32 provided by the invention are connected and held together at their leading ends 40 (represented by the "X" in FIG. 3) to make it easier to splice a new supply of stock material 34 and 43 to an almost-spent supply of stock material 45 being fed through and consumed by the conversion machine 30. The plies $P_1$ and $P_2$ may be held together by any means, although generally only a temporary connection is required as the plies $P_1$ and $P_2$ generally follow separate paths within the machine 30 and thus will be separated by the operation of the conversion machine 30.

The supplies 34 and 43 of sheet stock material 32 also include a pre-applied layer of adhesive 42 adjacent either a leading end 40 or a trailing end 46 of each ply $P_1$ and $P_2$ to attach the leading ends 40 of each ply $P_1$ and $P_2$ of the new supply of stock material 34 or 43 to the trailing ends 46 of respective plies $P_1$ and $P_2$ of the almost-spent supply of stock material 45. Alternatively, an adhesive layer 42 may be applied near a leading end 40 of one ply $P_1$ or $P_2$, and near a trailing end 46 of the other ply $P_2$ or $P_1$. Further, the adhesive layers 42 on respective plies $P_1$ and $P_2$ may be longitudinally aligned, as shown in FIGS. 1 and 3, or offset, as shown at the leading end 40 in FIG. 2. The adhesive layer 42 typically is disposed on the same end 40 or 46 of each ply $P_1$ and $P_2$, applied to outwardly-facing surfaces 60, 62 of the plies $P_1$ and $P_2$ at the leading end 40 or to inwardly-facing surfaces 64, 66 at the trailing end 46. Both arrangements are shown in FIG. 2, but usually only one is necessary.

The adhesive layer 42 typically is covered with a removable cover 70, sometimes referred to as a release liner, to protect the adhesive layer 42 until it is needed. An exemplary adhesive is a pressure-sensitive adhesive. The adhesive layer 42 and release liner 70 extend transversely across the width of the ply $P_1$ and $P_2$. By removing the release liner 70, such as by manually peeling same from the adhesive layer 42, the leading end 40 of the stock material 32 may be spliced to, or more particularly adhered to, a corresponding surface of a trailing end 46 of an almost-spent supply of stock material 45 extending from the upstream end 52 of the machine 30 of FIG. 1.

The adhesive layer 42 also may be provided as a double-sided tape that is secured to the stock material 32. As another alternative, a cohesive may be applied to both the outwardly facing surfaces of the plies $P_1$ and $P_2$ adjacent their leading ends 40 and to inwardly-facing surfaces adjacent their trailing ends 46. A cohesive is like an adhesive but only sticks to other cohesive or cohesive-coated surfaces. Consequently only one of the inwardly-facing surfaces would require a removable release liner. When the cohesive is applied to the outwardly-facing surfaces, the layer of sheet stock material underlying or adjacent the adhesive layer 42 may serve as the release liner, enabling the clean and easy removal of the adhesive layer 42 therefrom.

The adhesive layer 42 may include a reduced strength adhesive, meaning a pressure sensitive adhesive that enables a release liner 70 to be cleanly and easily removed from the adhesive layer 42 to expose the adhesive layer, which exposed adhesive layer 42 may be removably adhered to the sheet stock material 32. This permits the sheet stock material 32 to be wound, or stacked, on top of itself, i.e., to contact the underlying adjacent layer of sheet stock material 32. In addition, this permits the sheet stock material 32 to be repositioned when splicing. The reduced strength adhesive provides sufficient adhesive holding power and shear strength between the spliced plies $P_1$ or $P_2$ to hold the leading end 40 and the trailing end 46 together when subjected to a longitudinal pulling force. An exemplary adhesive is the adhesive used for Highland™ brand removable notes manufactured by the 3M Company of St. Paul, Minn., U.S.

With a reduced strength adhesive, the leading end 40 of a ply $P_1$ or $P_2$ of sheet material 32 may be repositioned, as desired, to obtain the appropriate alignment between the leading end 40 of the ply $P_1$ of sheet material 32 of the succeeding supply of stock material with the trailing end 46 of the ply $P_1$ of the almost-spent supply of stock material. The adhesive layer 42 has sufficient shear strength and adhesive holding power to maintain the splice (i.e., the adhesive bond) of the leading end 40 of the succeeding supply of stock material 34 to the trailing end 46 of the almost-spent supply of stock material when the stock material 32 is advanced through the conversion machine 30.

Alternatively, the adhesive layer 42 may include an adhesive having a holding power and shear strength that provides a permanent bond (i.e., not removable) between the plies of sheet stock material when spliced. In this case, the adjacent layer of sheet stock material, or at least the portion of the adjacent layer of stock material which the adhesive layer 42 overlaps, will require a surface treatment such as by application of a coating of a material which would enable clean and easy removal of the adhesive layer 42 from the overlapped portion; in other words, to enable the overlapped portion to operate as the release liner.

To splice the leading end 40 of a new supply of stock material 34 or 43 to the trailing end 46 of an almost-spent supply of stock material 45, the leading end 40 of the sheet material 32, is removed (i.e., unwound or unfolded) from the new supply of stock material 34 or 43 and the outwardly-facing surfaces of the respective plies $P_1$ and $P_2$ are spliced to, or more particularly adhered to, the inwardly-facing surfaces of the trailing ends 46 of the respective plies $P_1$ and $P_2$ of the almost-spent supply of stock material 45.

Figure 4:
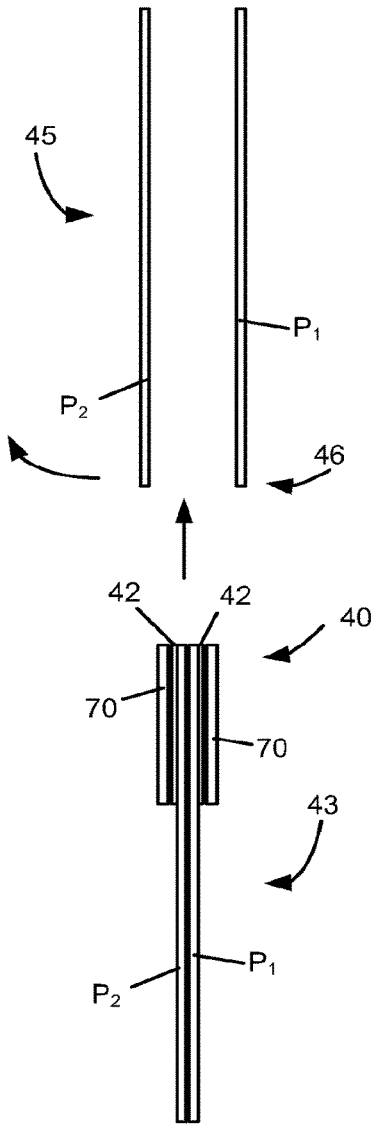
FIGS. 4 to 6 are sequential schematic illustrations of trailing ends of an almost-spent supply of sheet stock material being spliced to leading ends of a new supply of sheet stock material according to the present invention.
Figure 5:
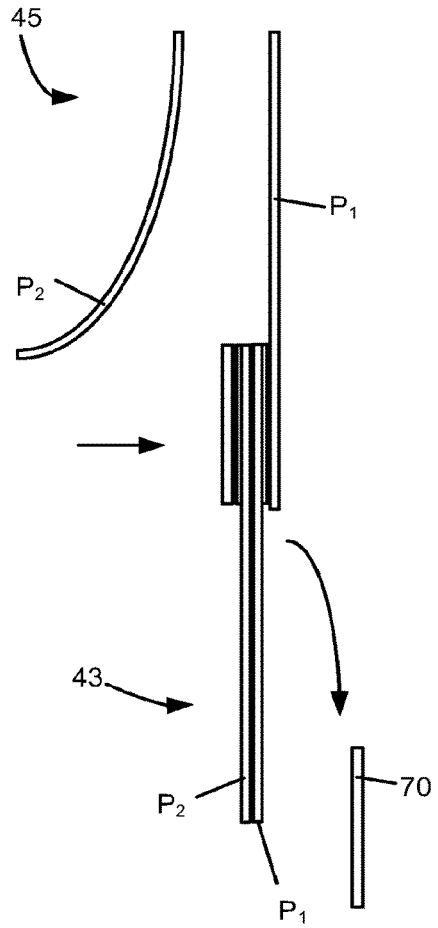
Figure 6:
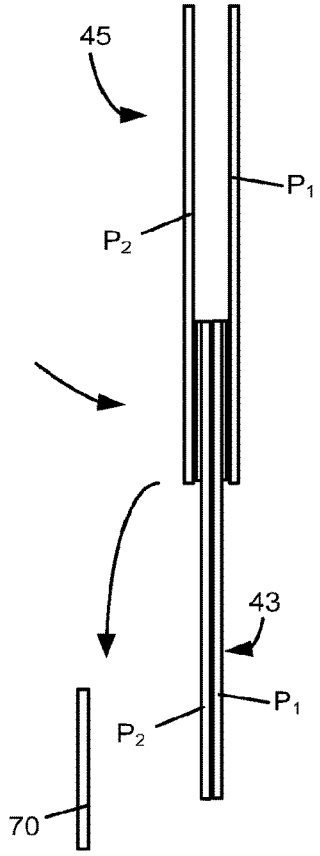

A method of employing the stock material 32 provided by the invention is illustrated in FIGS. 4 to 6. In this sequence, an operator will connect the trailing ends 46 of a first ply $P_1$ and a second ply $P_2$ of an almost-spent supply of sheet stock material 45 protruding from a conversion machine 30 (FIG. 1) to a leading end 40 of a corresponding first ply $P_1$ and second ply $P_2$ of a new supply of sheet stock material 43. The leading ends 40 of the plies $P_1$ and $P_2$ of the new supply 43 are connected together. In this example, an adhesive layer 42, covered by a removable release liner 70, has been applied to outwardly-facing surfaces adjacent a leading end 40 of each ply $P_1$ and $P_2$ of the new supply 43. To splice the plies $P_1$ and $P_2$ of the new supply 43 to the plies $P_1$ and $P_2$ of the almost-spent supply 45, the operator will first lift one ply $P_1$ or $P_2$ of the almost-spent supply 45, generally the nearest ply $P_1$, out of the way. Then the operator will remove the release liner 70 from one of the adhesive layers 42, generally the release liner 70 on the surface facing away from the operator, and the operator will press the exposed adhesive layer 42 to an inwardly-facing surface at the trailing end 46 of the corresponding ply $P_1$ of the almost-spent supply 45, connecting the corresponding plies together. Because the leading ends 40 of the plies $P_1$ and $P_2$ of the new supply 43 also are attached together, both plies $P_1$ and $P_2$ of the new supply 43 of stock material are now connected to one of the plies $P_1$ of the almost-spent supply of stock material 45. The operator then removes the release liner 70 from the other adhesive layer 42 and replaces the trailing end 46 of the previously-lifted ply $P_1$ over the exposed adhesive layer 42 and presses the plies together.

Figure 7:
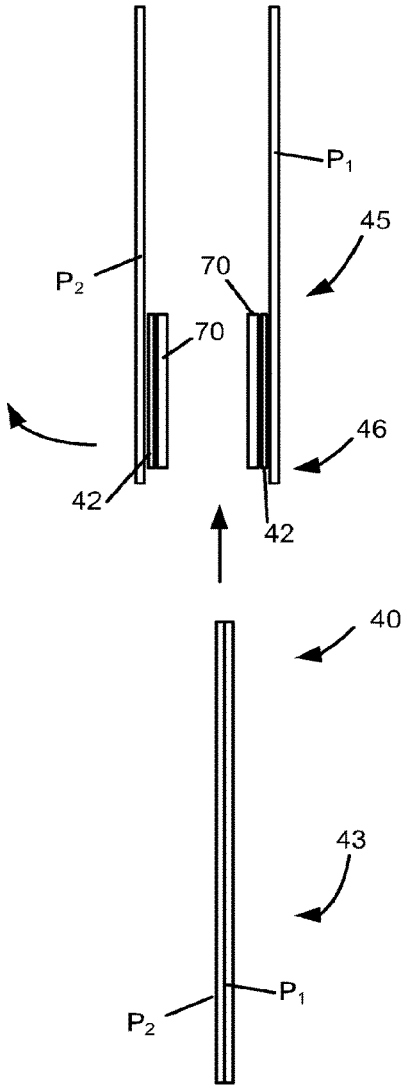
FIGS. 7 to 9 are sequential schematic illustrations of trailing ends of an almost-spent supply of sheet stock material being spliced to leading ends of a new supply of sheet stock material according to an alternative provided by the present invention.
Figure 8:
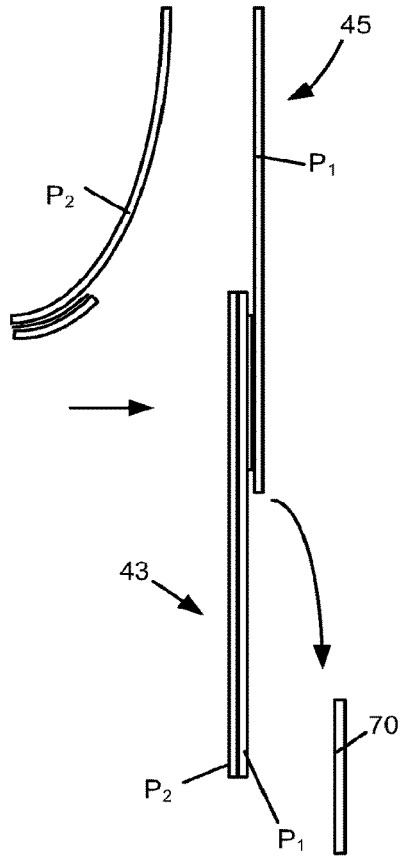
Figure 9:
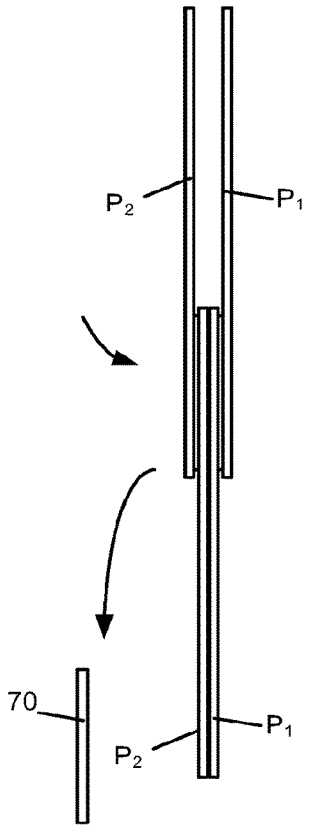

An alternative method is shown in FIGS. 7 to 9, which illustrates the corresponding case where the adhesive layers 42 are applied to the trailing ends 46 of the plies $P_1$ and $P_2$ of stock material 43. In this case, the adhesive layers 42 are applied to the inwardly-facing surfaces of the trailing ends 46 of the stock material 32, meaning the almost-spent supply of stock material 45 will include adhesive layers 42. Once again, one ply $P_1$ is moved out of the way, a release liner 70 is removed from the other ply $P_2$, and the leading end 40 of the plies $P_1$ and $P_2$ of the new supply 43 are bound to the trailing end 46 of one ply $P_2$ with the exposed adhesive layer 42 by pressing the overlapping plies together. Then the other release liner 70 is removed and the other ply $P_1$ of the almost-spent supply 45 is connected to the opposing face of the new supply of stock material 43 by replacing the other ply $P_1$ of the almost-spent supply 45 over the leading end 40 of the new supply 43 and pressing the plies together.

Because the plies $P_1$ and $P_2$ typically travel slightly different paths through the conversion machine 30 (FIG. 1), the leading ends 40 of the plies $P_1$ and $P_2$ of the new supply 43 generally will separate within the conversion machine 30. The plies $P_1$ and $P_2$ can be connected in different ways. In FIGS. 10-20 an adhesive layer 42 is applied adjacent a leading end 40 of plies $P_1$ and $P_2$ of sheet stock material 32. The methods of connecting the plies that are illustrated in these figures, however, could be replaced with tape that is separate from the adhesive layer 42. Additionally, the adhesive layer 42 used to connect the plies $P_1$ and $P_2$ of the new supply 43 to the plies $P_1$ and $P_2$ of the almost-spent supply 45 could be applied to the trailing ends 46 of the plies $P_1$ and $P_2$.

Figure 10:
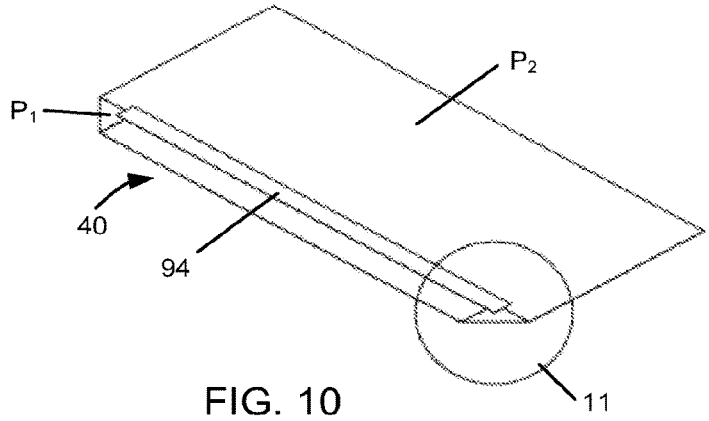
FIG. 10 is a perspective view of a leading end of a supply of sheet stock material having two plies, illustrating a method of connecting the plies.
Figure 11:
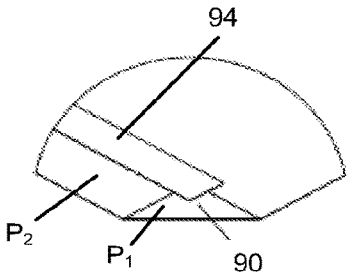
FIG. 11 is an enlarged view of portion 11 of FIG. 10.
Figure 12:
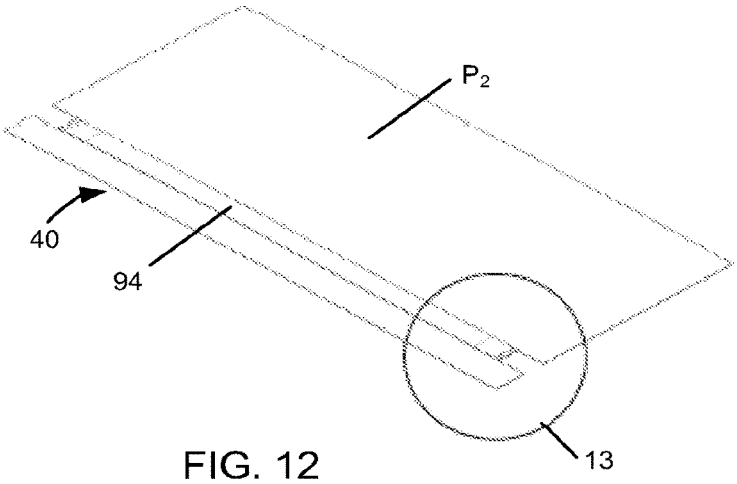
FIG. 12 is a perspective view of a leading end of a supply of sheet stock material having two plies, illustrating an alternative method of connecting the plies.
Figure 13:
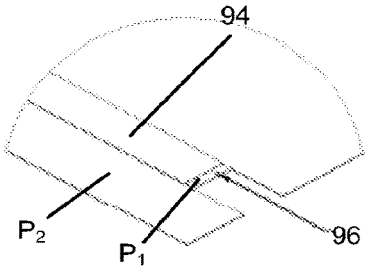
FIG. 13 is an enlarged view of portion 13 of FIG. 12.

In FIGS. 10 and 11, the corners of the leading ends 40 of both plies $P_1$ and $P_2$ are folded over, such that a corner portion 90 of a first ply $P_1$ overlies a corner portion (not shown) of a second ply $P_2$. Consequently, an outwardly-facing surface of the first ply $P_1$ at the corner faces in an opposite direction, the same direction as the outer surface of a second ply $P_2$. The folded-over corner portions 90 then are taped down with a layer of tape 94 to hold the leading ends 40 of the first ply $P_1$ and the second ply $P_2$ together. Other methods may be used to hold the folded-over corner portions 90 in place, such as an adhesive, a cohesive, a fastener such as a staple, or a punched portion, such as described below. The leading ends 40 of the first ply $P_1$ and the second ply $P_2$ are not connected together in a central portion, widthwise, between the corner portions. The tape 94 may be a double-sided tape or may have an adhesive layer placed over or adjacent the tape 94 for splicing to the plies of an almost-spent supply (not shown).

Figure 14:
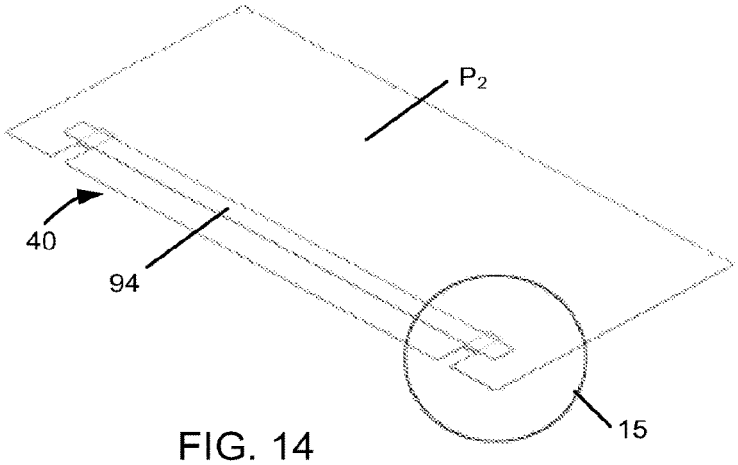
FIG. 14 is a perspective view of a leading end of a supply of sheet stock material having two plies, illustrating an alternative method of connecting the plies.
Figure 15:
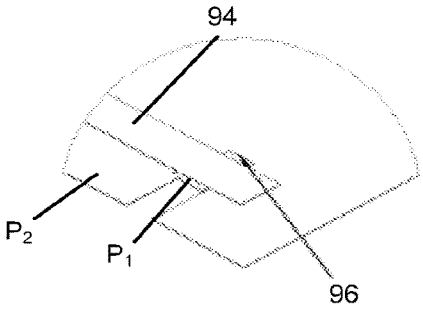
FIG. 15 is an enlarged view of portion 15 of FIG. 14.

Similarly, one or more pairs of spaced-apart cuts may be made through both plies $P_1$ and $P_2$ at either a side near a leading end 40 (FIGS. 12 and 13) or at spaced-apart locations in the leading end 40 (FIGS. 14 and 15). The parallel cuts form tabs 96 that are then folded over an outer surface of one ply $P_1$ or $P_2$ and secured in place, such as with a tape 94 or other technique as described in connection with FIGS. 10 and 11. Consequently, a formerly outwardly-facing surface of the first ply $P_1$ now faces in the opposite direction, as was the case with the corner portions 90 and 92 of FIGS. 10 and 11. The tabs 96 formed in the leading ends 40 of the first and second ply $P_1$ and $P_2$ in FIGS. 14 and 15 may be near the corners or spaced inwardly from the corners, and may be nearer a center of the width of the leading ends 40 of the plies $P_1$ and $P_2$.

Figure 16:
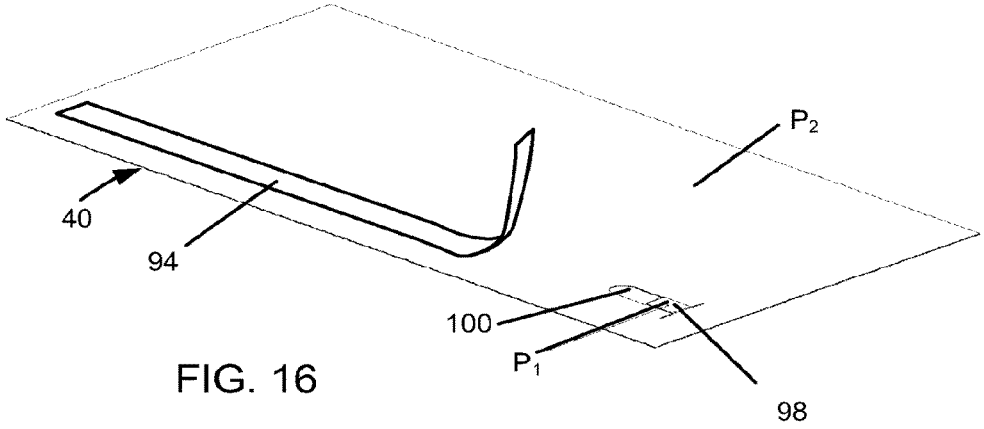
FIG. 16 is a perspective view of a leading end of a supply of sheet stock material having two plies, illustrating an alternative method of connecting the plies.

Another alternative is shown in FIG. 16, where a tab 98 is cut from both plies at a location inwardly spaced from the edges of the plies $P_1$ and $P_2$. A continuous cut through both plies $P_1$ and $P_2$ forms a tab 98 in each ply $P_1$ and $P_2$. The tab 98 is then folded over an outside surface of one of the plies $P_1$ or $P_2$, creating an opening in the ply $P_1$ or $P_2$ that had been filed by the tab 98. In other words, a tab 98 from a first ply $P_1$ is pushed through an opening 100 in a second ply $P_2$, over the tab formed in the second ply $P_2$, and over an outside surface of the second ply $P_2$. The tabs 98 are then secured in place, such as with a tape 94 as shown. This technique can be used to hide the tabs 98 and openings 100, which may be desirable in some applications. Although only one connecting tab 98 and opening 100 are shown in FIG. 16, additional tabs 98 may be used to connect the leading ends 40 of the first ply $P_1$ and the second ply $P_2$ together.

Figure 17:
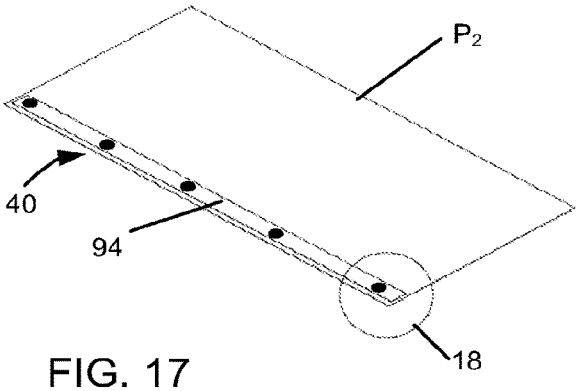
FIG. 17 is a perspective view of a leading end of a supply of sheet stock material having two plies, illustrating an alternative method of connecting the plies.
Figure 18:
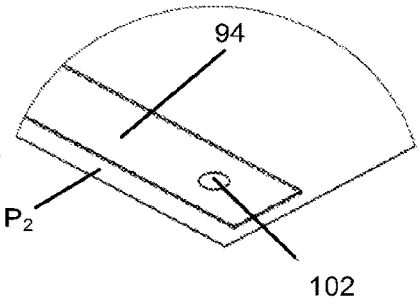
FIG. 18 is an enlarged view of portion 18 of FIG. 17.
Figure 19:
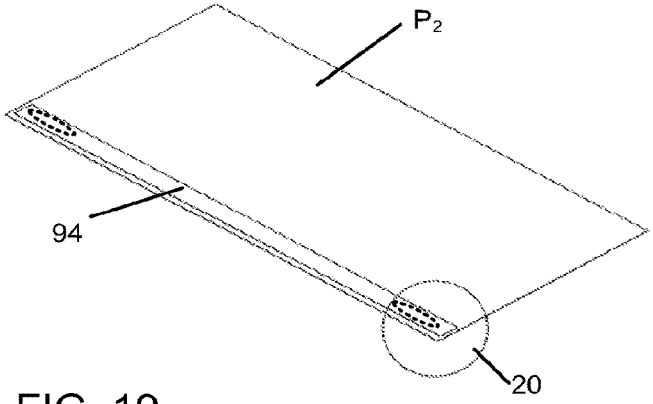
FIG. 19 is a perspective view of a leading end of a supply of sheet stock material having two plies, illustrating an alternative method of connecting the plies.
Figure 20:
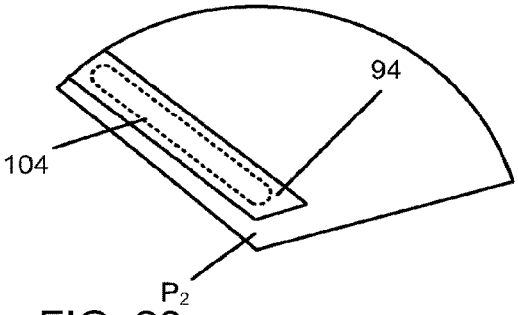
FIG. 20 is an enlarged view of portion 19 of FIG. 20.

The plies $P_1$ and $P_2$ also can be connected together by layers of tape 94 applied on both sides of the opening 100, to the outwardly-facing surfaces of both plies $P_1$ and $P_2$, with the adhesive tape 94 on one ply $P_1$ secured to the adhesive tape 94 on the other ply $P_2$ through the opening 100. This arrangement can be used in addition to tabs 98, such as in FIG. 16, or in place of tabs 98, as shown in FIGS. 17 to 20. In FIGS. 17 and 18, holes 102 are punched through the overlapping plies $P_1$ and $P_2$ at spaced locations across a width of the leading ends 40 of the plies $P_1$ and $P_2$, and portions of tape 94 applied to the outwardly-facing surfaces of the plies $P_1$ and $P_2$ connect via the holes 102. An alternative hole arrangement is shown in FIGS. 19 and 20, where elongated slots 104 cut through the plies $P_1$ and $P_2$ form openings that allow the opposing portions of tape 94 to attach to one another through the slots 104. These slots 104 may be formed near the corners at the leading ends 40 of the plies $P_1$ and $P_2$, or may be spaced inwardly from the corners. In the examples shown in FIGS. 17 to 20 the tape 94 covers the slots 104 in the plies $P_1$ and $P_2$, which may be desirable in some applications.

Figure 21:
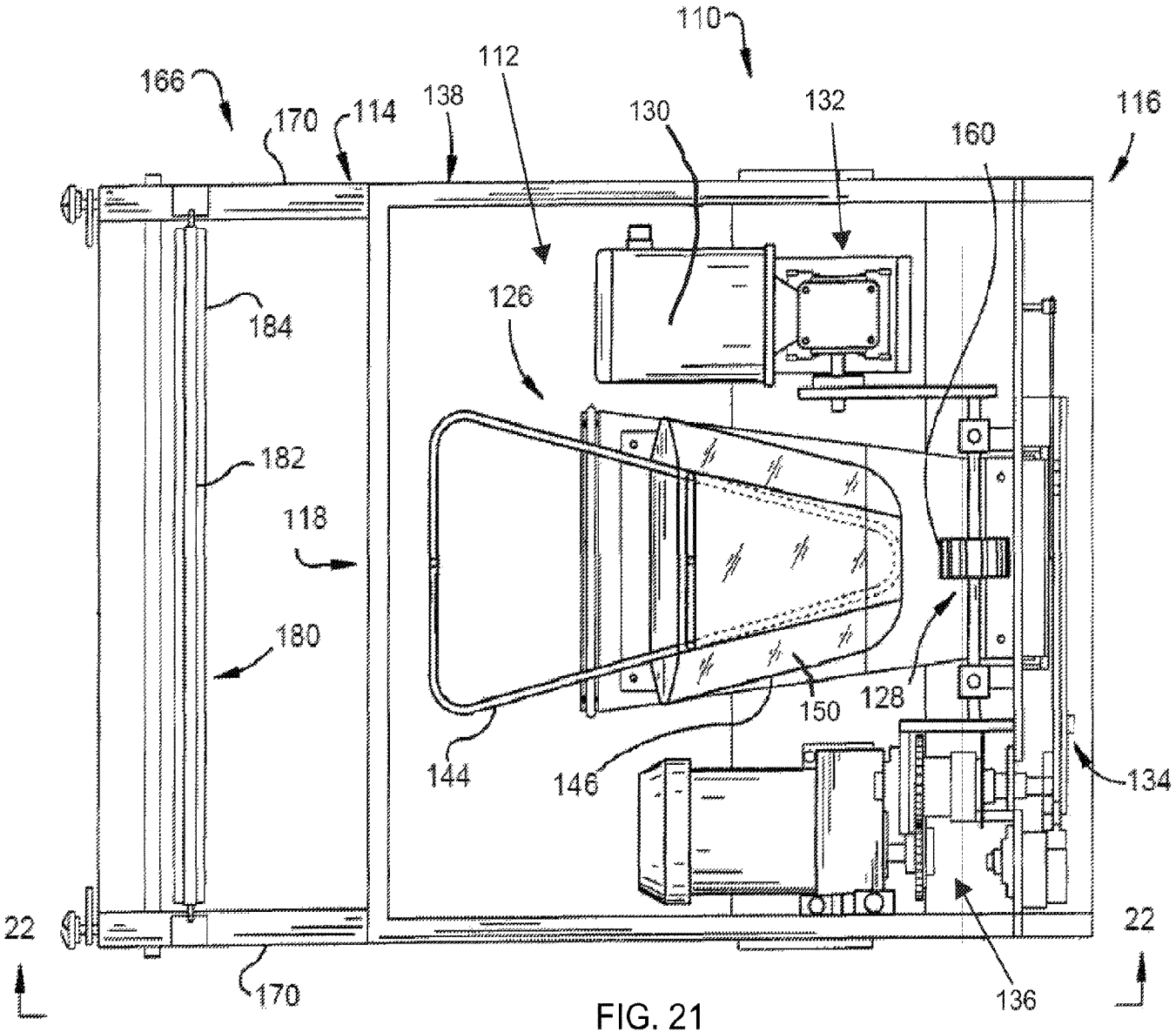
FIG. 21 is a top plan view of an exemplary dunnage conversion machine for use with the present invention.
Figure 22:
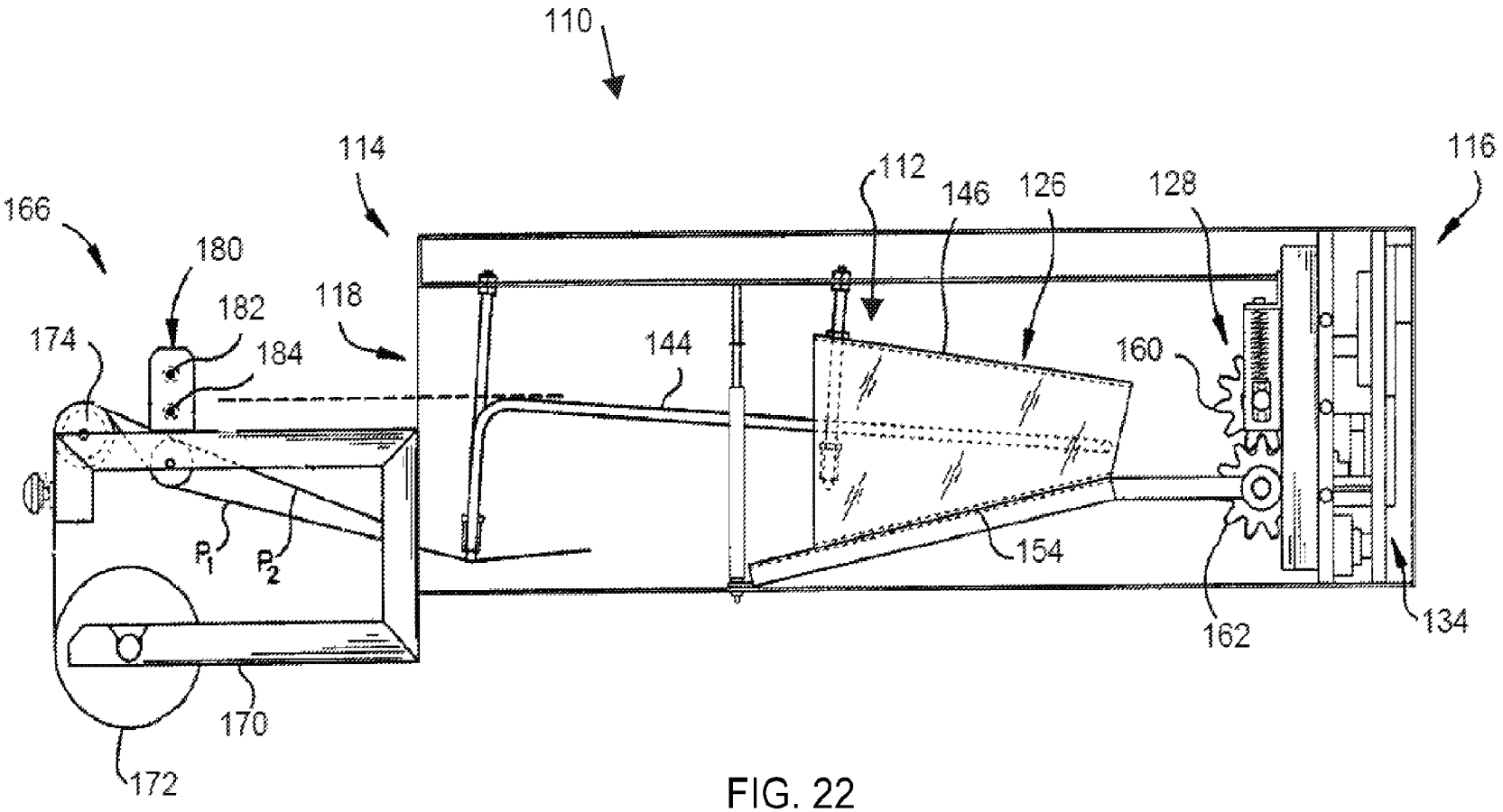
FIG. 22 is a side elevational view of the dunnage conversion machine of FIG. 21, the machine being shown in a horizontal manner, loaded with stock material, and with an outer housing side wall removed for clarity of illustration.

An exemplary dunnage conversion machine 110 is shown in FIGS. 21 and 22. The conversion machine 110 includes a conversion assembly, indicated generally at 112, and generally has an upstream end 114 and a downstream end 116. The stock material enters the conversion assembly 112 through an opening 118 at the upstream end 114 for passage through the conversion assembly 112 where it is converted into a strip of dunnage that exits from the downstream end 116 of the conversion assembly 112. This construction is typical of any dunnage conversion machine, and the invention is not limited to the particular dunnage conversion machine shown and described.

The illustrated conversion assembly 112 includes a former or forming assembly 126 and a feeding/connecting assembly 128 powered (energized) by a feed motor 130, for example an electric motor, through a motion transfer assembly 132. Downstream of the feeding/connecting assembly, a severing assembly 134 (for example a cutting assembly) powered by suitable means, such as the illustrated motor and motion transfer assembly 136 is provided to separate lengths or sections of dunnage products from the generally continuous strip of dunnage produced by the feeding/connecting assembly 128. The forming assembly 126, the feeding/connecting assembly 128, and the severing assembly 134 are mounted to or in a housing 138 in a well-known manner. The operation of the conversion machine 110 may be controlled by a controller, also in a well-known manner. As will be apparent, other types of conversion assemblies may be employed to convert the sheet material to a strip of dunnage, and other types of severing assemblies may be employed to separate discrete sections of dunnage products from the strip of dunnage produced by the conversion assemblies.

The illustrated forming assembly 126 includes a forming member 144, such as a forming frame, and a converging shaping chute 146. The forming assembly 126 randomly crumples the sheet stock material and causes an inward rolling or folding of the lateral edges of the sheet stock material to form a continuous strip of cushioning having lateral pillow-like portions. The shaping chute 146 includes longitudinally extending, transversely converging side walls 150 which preferably are curved or arcuate in transverse cross-section. As the sheet stock material passes through the shaping chute 146, the side edges turn or roll inwardly towards one another so that the inwardly turned or rolled edges form resilient pillow-like crumpled portions of stock material disposed in lateral abutting relationship as they emerge from the exit end of the shaping chute.

The forming member 144 coacts with the shaping chute 146 to randomly crumple the stock material, while also shaping and forming the stock material, including guiding a central portion of the stock material along the bottom wall 154 of the shaping chute 146 for controlled inward rolling or folding of the side edge portions of the stock material.

The illustrated feeding/connecting assembly 128 includes a pair of cooperating and opposed gears or gear-like members 160 and 162. The gears 160 and 162 of the feeding/connecting assembly 128 perform two functions in the operation of the machine 110. One function is a "feeding" function, with the gears pulling the stock material from the supply of stock material and then through the forming assembly 126. The stock material is then discharged by the feeding/connecting assembly 128 to the severing assembly 134. The second function that may be performed by the feeding/connecting assembly 128 is a connecting function. Specifically, the feeding/connecting assembly 128 connects overlapping layers of stock material along a central band, passing between the two opposing gears 160 and 162 to form a connected strip. Other mechanisms may be employed to "connect" the strip, i.e., to operate on the strip in such a manner that it will retain its shape as opposed to reverting to the original flat form of the stock material. Known connecting mechanisms include mechanisms that crease the stock material to enable the stock material to hold its three-dimensional shape, and mechanisms that "punch" tabs through overlapping layers to hold those layers together.

The connected strip travels downstream from the feeding/connecting assembly 128 to the severing assembly 134 which severs, for example by cutting, the strip into a section of a desired length.

Referring now to the upstream end 114 of the conversion machine 110, the stock material is supplied to the conversion machine 110 from a stock supply assembly 166. The illustrated stock supply assembly includes a pair of C-shape laterally spaced apart mounting brackets 170 secured to the conversion assembly 112. When rolled stock material is used with the conversion machine 110, the lower legs of the brackets 170 have journaled between the ends thereof a stock supply roll 172. When fan-folded stock material (FIG. 3) is used with the machine 110, the lower legs are not necessary. The upper legs of the brackets 170 have journaled between the ends thereof a constant entry roller 174 that provides a non-varying point of entry for the sheet stock material from the supply. The brackets 170 also support therebetween a separating device 180 which receives the sheet stock material from the constant entry roller 174 and separates the two plies $P_1$ and $P_2$ from one another via transversely extending separator members 182 and 184 prior to passing beneath the forming member 144 and into the shaping chute 146. The separating device 180 will separate the plies $P_1$ and $P_2$ as the connected leading ends of the plies pass the separating device before entering the conversion assembly so that each ply can crumple independently during the conversion process.

As described above, when the trailing ends of the plies of an almost spent supply of stock material are held, the leading ends of the plies of a succeeding supply of stock material may be spliced to the trailing ends. To detect that a supply of stock material is nearing its depleted or spent state, an end of web detector may be included upstream of the conversion assembly to detect the trailing end of one or more plies before the trailing ends of the stock material are pulled into the conversion machine.

In summary, in FIG. 1 the next or succeeding supply of stock material 34 or 43 (FIG. 2) is in a position for splicing with an almost-spent or depleted supply of stock material 45, the plies $P_1$ and $P_2$ of which are shown at an upstream end 52 of the conversion machine 30. To splice the succeeding supply of stock material 34 or 43 to the almost-spent supply of stock material 45, the liners 70 are released from the adhesive layers 42 of the respective plies $P_1$ and $P_2$ of the new supply of stock material 34 or 43 and the adhesive layers 42 are applied to inner surfaces of the trailing ends 46 of the plies $P_1$ and $P_2$ of the almost-spent supply of stock material 45. Both of the liners 70 may be released before applying the adhesive layers 42 to the respective trailing ends 46 of the almost-spent supply of stock material 45 or, alternatively, each time a liner 70 is released the respective adhesive layer 42 is applied to the appropriate ply $P_1$ and $P_2$ before releasing another liner 70.

Thus, the present invention provides a supply of stock material 34 and 43 for a dunnage conversion machine 30 that includes two plies $P_1$ and $P_2$ of sheet stock material 32 wound into a roll 44 or fan-folded into a stack 56 (FIG. 2). The plies $P_1$ and $P_2$ may be attached together at a leading end 40, and each ply $P_1$ and $P_2$ has disposed on a corresponding leading end 40 or trailing end 46 an adhesive layer 42 and a removable release liner 70 covering the adhesive layer 42. When applied to a leading end 40 of the supply 34 or 43, the adhesive layer 42 is applied to opposing, outwardly-facing surfaces of the respective plies $P_1$ and $P_2$. When a supply of stock material 34 is almost spent, the operator removes the release liners 70 from both plies $P_1$ and $P_2$ to expose respective adhesive layers 42, and then interposes the leading end 40 of a new supply 34 or 43 between the plies $P_1$ and $P_2$ at the trailing end 46 of the plies of the almost-spent supply 45 and presses the layers together to attach the plies $P_1$ and $P_2$ of the new supply 34 or 43 to respective plies $P_1$ and $P_2$ of the almost-spent supply 45, for conversion into dunnage 36.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

The invention claimed is:

1. A method of converting a two-ply sheet stock material into a relatively lower density dunnage product, comprising the following steps:

operating a dunnage conversion machine to produce one or more dunnage products from a supply of sheet stock material having a first ply and a second ply until the supply of sheet stock material is almost spent, the supply being a preceding supply;

displacing a trailing end of the second ply of the preceding supply of sheet stock material to expose a trailing end of the first ply of the preceding supply of sheet stock material;

providing a succeeding supply of two-ply sheet stock material having a first ply and a second ply that overlaps the first ply, the first ply and the second ply generally being unconnected to each other, wherein leading ends of the first ply and the second ply of the succeeding supply of sheet stock material are connected together;

attaching a leading end of the first ply of the succeeding supply of sheet stock material to the first ply of the preceding supply of sheet stock material;

replacing the trailing end of the second ply of the preceding supply of sheet stock material over the leading end of the second ply of the succeeding supply of sheet stock material to secure the second ply of the succeeding supply of sheet stock material to the second ply of the preceding supply of sheet stock material; and operating the dunnage conversion machine once again to produce one or more dunnage products from the succeeding supply of sheet stock material.

2. A method as set forth in claim 1, wherein the attaching step includes removing a release liner covering a pressure sensitive adhesive layer and applying pressure to the sheet stock material adjacent the adhesive layer.

3. A method as set forth in claim 2, wherein the providing step includes providing the first ply and the second ply of the succeeding supply of sheet stock material with the adhesive layer covered by the removable release liner adjacent the leading end of each ply.

4. A method as set forth claim 1, further comprising connecting the leading ends of the first ply and the second ply of the succeeding supply of sheet stock material before the attaching step.

5. A method as set forth in claim 4, wherein the connecting step includes securing the first ply and the second ply together adjacent their respective leading ends with an adhesive between inwardly-facing surfaces of the plies.

6. A method as set forth in claim 1, wherein the providing step includes providing the succeeding supply with the first and second plies rolled or folded into a compact configuration.

7. A method as set forth in claim 1, wherein the providing step includes providing the succeeding supply with the first and second plies rolled around a common core to form a roll of two-ply sheet stock material.

8. A method as set forth in claim 1, wherein the providing step includes providing the succeeding supply with the first and second plies fan-folded to form a stack of two-ply sheet stock material.

9. A method as set forth in claim 1, wherein the providing step includes providing the succeeding supply with paper as at least one of the first ply and the second ply.

10. A method as set forth in claim 1, wherein the first and second plies of the succeeding supply of sheet stock material have substantially the same width dimension.

11. A method as set forth in claim 1, wherein the providing step includes providing the succeeding supply where each of the first ply and the second ply has an adhesive layer adjacent a leading end, and the adhesive layer has a substantially continuous length.

12. A method as set forth in claim 1, wherein the providing step includes providing the succeeding supply where each of the first ply and the second ply has an adhesive layer adjacent a leading end, and the adhesive layer has a major dimension that extends parallel to a width dimension of the overlapping plies.

13. A method as set forth in claim 1, wherein the providing step includes providing the succeeding supply where each of the first ply and the second ply has an adhesive layer adjacent a leading end, and the adhesive layer on the first ply is aligned with the adhesive layer on the second ply.

14. A method as set forth in claim 1, wherein the providing step includes providing the succeeding supply where the leading end of the first ply is aligned with the leading end of the second ply.

* * * * *